US009287018B2

(12) United States Patent
Chen et al.

(10) Patent No.: US 9,287,018 B2
(45) Date of Patent: Mar. 15, 2016

(54) METHOD OF PREPARING SILVER-BASED ELECTRICAL CONTACT MATERIALS WITH FIBER-LIKE ARRANGEMENT OF REINFORCING NANOPARTICLES

(75) Inventors: Lesheng Chen, Yueqing (CN); Xiao Chen, Yueqing (CN); Gengxin Qi, Yueqing (CN); Chengfa Mu, Yueqing (CN)

(73) Assignee: Wenzhou Hongfeng Electrical Alloy Co., Ltd., Yueqing, Zhejiang (CN)

( * ) Notice: Subject to any disclaimer, the term of this patent is extended or adjusted under 35 U.S.C. 154(b) by 247 days.

(21) Appl. No.: 13/577,893

(22) PCT Filed: Apr. 11, 2011

(86) PCT No.: PCT/CN2011/000630

§ 371 (c)(1), (2), (4) Date: Aug. 8, 2012

(87) PCT Pub. No.: WO2012/071767

PCT Pub. Date: Jun. 7, 2012

(65) Prior Publication Data

US 2013/0313488 A1 Nov. 28, 2013

(30) Foreign Application Priority Data

Dec. 3, 2010 (CN) ..... 2010 1 057801

(51) Int. Cl.
*H01B 1/02* (2006.01)
*C23C 30/00* (2006.01)

(52) U.S. Cl.
CPC . *H01B 1/02* (2013.01); *C23C 30/00* (2013.01)

(58) Field of Classification Search
CPC ..... H01B 1/02; C23C 3/00; C22C 1/04; H01H 1/02
USPC ..... 252/514; 427/125
See application file for complete search history.

(56) References Cited

U.S. PATENT DOCUMENTS 5,372,750 A * 12/1994 Thoma ..... 252/512
2007/0228334 A1* 10/2007 Goia et al. ..... 252/500

FOREIGN PATENT DOCUMENTS

CN 101217074 A * 7/2008
CN 101649401 A * 2/2010
CN 101651054 A * 2/2010
JP 2005146412 A * 6/2005

* cited by examiner

*Primary Examiner* — Mark Kopec
*Assistant Examiner* — Danny N Kang

(57) ABSTRACT

A method for preparing silver-based electrical contact materials with fiber-like arrangement of reinforcing nanoparticles includes (1) uniformly mixing reinforcement powders and silver matrix powders for ball milling; (2) pouring the obtained composite powders and silver matrix powders into a powder mixing machine for powder mixing; (3) cold isostatic pressing; (4) sintering; (5) hot pressing; and (6) hot extruding to obtain silver-based electrical contact materials with fiber-like arrangement of reinforcing nanoparticles. The method of the present invention can obtain silver-based electrical contact materials with fiber-like arrangement of reinforcing nanoparticles with no specific requirement on processing deformation, and the plasticity and ductility of the reinforcing phase. Furthermore, it has simple processes, low cost and no particular requirements on the equipment. Contact materials prepared by the present method have good resistance to welding and arc erosion, conductivity and a greatly enhanced processing performance.

17 Claims, 1 Drawing Sheet

METHOD OF PREPARING SILVER-BASED ELECTRICAL CONTACT MATERIALS WITH FIBER-LIKE ARRANGEMENT OF REINFORCING NANOPARTICLES

CROSS REFERENCE OF RELATED APPLICATION

This is a U.S. National Stage under 35 USC 371 of the International Application PCT/CN2011/000630, filed Apr. 11, 2011.

BACKGROUND OF THE PRESENT INVENTION

1. Field of Invention

The present invention relates to a method for preparing an electrical contact material in a field of materials technology, and more particularly to a method of preparing a fibrous silver-based electrical contact material.

2. Description of Related Arts

With the rapid development of the electrical apparatus industry, the application of electrical apparatus switches has brought about increasingly high requirements on the performance of the electrical contact materials such as high resistance to welding and arc erosion and good conductivity. With regard to these requirements, worldwide researchers have made great efforts to improve the performance mainly by designing material composition and reinforcing particles dispersion uniformity. Compared to the silver-based composite material dispersion-reinforced by ordinary particles, the silver-based composite material reinforced by fiber-like arranged particles has better resistance to welding and arc erosion and a good processing property. The development of a simple and practical method which could be applied to large-scale production has attracted tremendous research interest and still remains to be a difficult point in the present research.

Some researches on silver-based electrical contact materials with fiber-like arrangement of reinforcing nanoparticles are stated as follows.

(a) Yonggen Wang, & etc., Study on the process of the fibrous AgNi composite wire, electrical engineering materials, Vol. 20, No. 1, 2007;

(b) Chinese patent, fibrous structure silver-based electrical contact material and preparation method thereof, having an application number of 200910196283.0 and a publication number of CN101707145A.

Three traditional methods of preparing silver-based electrical contact materials are as follows. The first is a method of conventional powder metallurgy sintering and extrusion, whose main process includes powder mixing, pressing, sintering, extruding, drawing, annealing, drawing and finally obtaining finished products. This method is unable to obtain the desired neat fibrous structure and may produce large reinforcing particles that severely undermine the performance of the products. The second is a modification of the first method with improved extrusion and increased processing deformation as recited in the research (a). This method is unable to provide fibrous silver-based materials when the processing deformation is small, such as extruding into strips or sheets. Furthermore, this method is not suitable for reinforcing phase with poor plasticity and ductility, such as $SnO_2$. The third refers to a combination of a pre-design of green body and an extruding method. More precisely, a certain number of reinforcing wires are fixed into a matrix through a mould in advance and subjected to isostatic pressing, sintering and extruding as recited in research (b). Although able to create neat and continuous fibrous structure, the third method is not applied to industrial-scale production because the third method is relatively complex and places particular requirement on the plasticity and ductility of the reinforcing wires. In addition, the third method requires that the silver-based wires with reinforcing materials be prepared in advance and fixed into the matrix through the mould. Therefore, it is understood that fibrous silver-based electrical contact materials cannot be obtained either by simple powder mixing or in the situation where the deformation is relatively small or where the reinforcing phase has poor plasticity and ductility.

SUMMARY OF THE PRESENT INVENTION

With regard to the weakness and defects in prior arts, the present invention provides a method for preparing silver-based electrical contact materials with fiber-like arrangement of reinforcing nanoparticles which places no particular requirements on processing deformation and the plasticity and ductility of the reinforcing phase. The method has simple process, easy operation, low cost and no specific requirements on the equipment. In the method of the present invention, obtained contact material has better resistance to welding and arc erosion and better conductivity, and processing performance is also improved.

In order to achieve the above object, the present invention adopts following technical solutions.

The present invention provides a method for preparing silver-based electrical contact materials with fiber-like arrangement of reinforcing nanoparticles comprising following steps of:

(A) uniformly mixing reinforcing powders with matrix silver powders, and then placing the mixed powders into a high energy ball milling tank for ball-milling, wherein the reinforcing powders and the matrix silver powders are mixed in such a proportion as to obtain silver-coated reinforcing powders and aggregates thereof;

(B) placing the composite powders obtained from step (A) and matrix silver powders into powder mixing machine for mixing, wherein a weight ratio of the composite powder body to the silver-matrix powder is calculated according to composition of desired materials and sizes of fibrous structure;

(C) processing powder body obtained from the step (B) with cold isostatic pressing;

(D) sintering green body obtained from step (C);

(E) hot pressing the green body obtained from step (D);

(F) hot extruding the green body obtained by hot pressing to obtain silver-based electrical contact materials with fiber-like arrangement of reinforcing nanoparticles.

The silver-based electrical contact materials with fiber-like arrangement of reinforcing nanoparticles prepared through the method of the present invention have reinforcing phase with a neat fibrous structure wherein the fibrous structure of the reinforcing material is formed through directional arrangement of particles thereof. The reinforcing particles have an average size between 5 nm and 30 μm and are made of one material or a mixture of several materials that can form silver-coated particles after being processed through high energy ball milling machine.

Different from conventional preparation methods combining mechanical alloying and large plastic deformation, the method of the present invention is described as follows. Firstly the silver powders and the reinforcing powders are processed with high energy ball milling for refinement through high energy collision and milling; and the refined silver powders coats on the reinforcing particles or the reinforcing particles are inlaid into the silver particles to further generate aggregates of coated bodies or inlaid bodies. Then, the aggregates and matrix Ag powders are uniformly mixed according to a predetermined recipe and orderly processed with isostatic pressing, sintering, hot pressing and hot extruding. During hot extruding, the aggregates move with softened Ag in the matrix of Ag. The reinforcing material can be conveniently separated and exhibits a fibrous structure with directional arrangement along the extrusion direction. Electrical contact materials prepared by the method of the present invention have a neat fibrous arrangement of the reinforcing phase and better performance. The resistance to arc erosion is 10% to 20% higher than the identical electrical contact material dispersion-reinforced by ordinary particles; electrical conductivity along the extrusion direction increases by 5% to 20%; resistance to welding increases by 10% to 20%; and electrical service life increases by 10% to 30%. In addition, the electrical contact material prepared by the method of the present invention has good processing performance and is suitable for large scale production.

These and other objectives, features, and advantages of the present invention will become apparent from the following detailed description, the accompanying drawings, and the appended claims.

DETAILED DESCRIPTION OF THE PREFERRED EMBODIMENT

Figure 1:
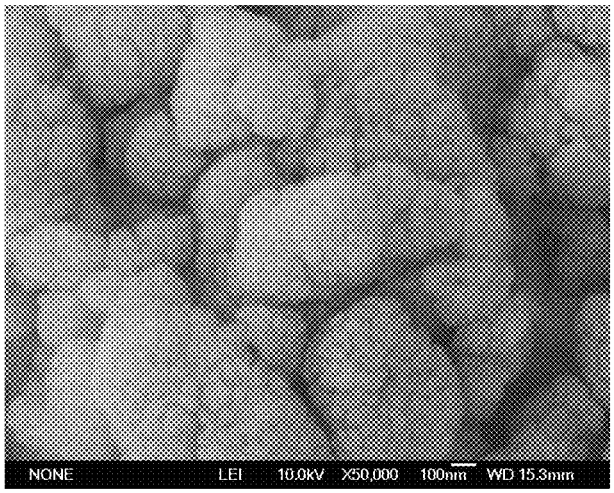
FIG. 1 is a scanning electron micrograph of aggregates of silver-coated $SnO_2$ particles according to a first preferred embodiment of the present invention.

The following is a more detailed description of the technical solution to the present invention and it is only to clarify the technical solution to the present invention within and with no limitation to the scope of the invention. The scope of protection of the present invention is subject to claims.

The present invention provides a method of preparing silver-based electrical contact materials with fiber-like arrangement of reinforcing nanoparticles which is suitable for ordinary preparation to yield fiber-reinforced silver-based contact materials with no particular requirements on processing deformation and plasticity and ductility of reinforcing phase. A production process of the method is simple and easy. Besides, there is no particular requirement on equipments.

The silver-based electrical contact material prepared by the method of the present invention has a neat fibrous reinforcing material, wherein the fibrous structure of the reinforcing material is formed through directional arrangement of the reinforcing particles. The particles of the reinforcing powder have an average size of 5 nm to 30 μm. The particles can be of one material or a mixture of materials and mixed with silver powders in such a proportion as to obtain silver-coated particles after being processed with high energy ball milling. In a specific preparation, the reinforcing material ratio is determined according to practical needs.

In the present invention, Ag matrix powder is obtained through atomization and sieving. Particle sizes of the silver powders range from 100 meshes to 400 meshes. The matrix power can be obtained by other conventional arts.

In the present invention, specific processing operation parameters of steps comprising ball milling, powder mixing, cold isostatic pressing, sintering, hot pressing and hot extruding can be optional. One preferred series of parameters are stated as follows.

In step 1, the reinforcing powders are uniformly mixed with the silver matrix powders and then placed in a high energy ball mill for milling, wherein the parameters are set as follows. A weight ratio of the reinforcing powder to silver powder is between 0.5 and 3; a milling speed ranges from 180 rpm to 280 rpm; a milling time is 5 to 12 hours.

In step 2, the ball-milled composite powders obtained from step 1 and silver powders are poured into a powder mixing machine for mixing, wherein the parameters are set as follows. A weight ratio of the composite powders to silver powder is between 1 and 0.136; a rotation speed of the powder mixing machine is between 20 rpm and 30 rpm; the powder mixing lasts for 2 to 4 hours.

In step 3, the powder obtained from the step 2 is processed with cold isostatic pressing, wherein the parameters are set as follows. The isostatic pressure is between 100 and 500 MPa.

In step 4, the green body obtained by cold isostatic pressing is sintered, wherein the parameters are set as follows. A sintering temperature is between 600° C. and 900° C. The sintering lasts for 5 to 9 hours.

In step 5, the green body obtained by sintering is processed with hot pressing, wherein the parameters are set as follows. A hot pressing temperature is between 500° C. and 900° C. A hot pressing pressure is between 300 to 700 MPa. The hot pressing lasts for 1 min to 30 min.

In step 6, the green body obtained through hot pressing is hot extruded to obtain silver-based electrical contact materials with fiber-like arrangement of reinforcing nanoparticles wherein the parameters are set as follows. The green body is heated at a temperature between 600-900° C. An extrusion ratio is between 20 and 400 and an extrusion speed is between 5 to 20 cm/min. A pre-heating temperature of extruding moulds is between 300 and 500° C.

Preferred embodiments of the present invention are presented as follows to further illustrate the present invention.

Embodiment One

Figure 2:
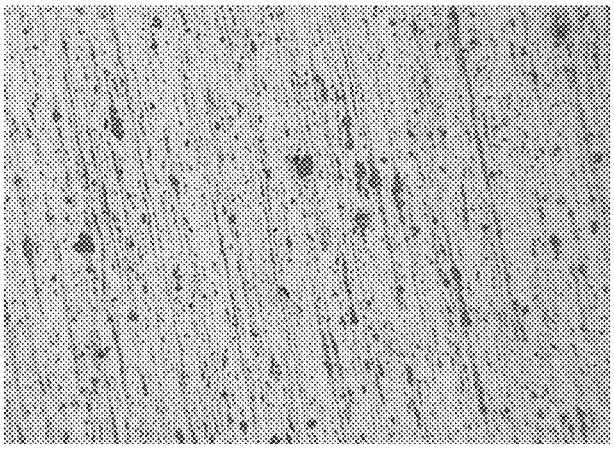
FIG. 2 is a metallograph of fibrous $AgSnO_2$(12) electrical contact material according to the first preferred embodiment of the present invention.
Figure 3:
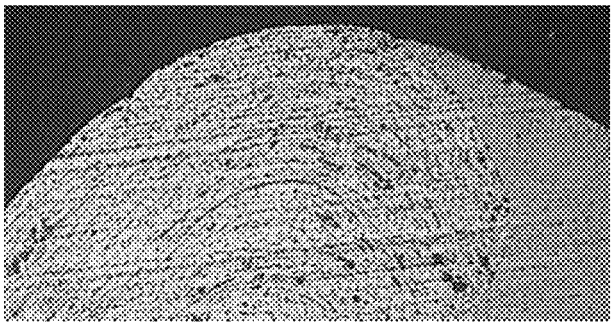
FIG. 3 is a metallograph of fibrous $AgSnO_2$(12) rivet contact according to the first preferred embodiment of the present invention.

A preparation of $AgSnO_2$ (12) contact material is taken as an example, referring to FIGS. 1 and 2.

Step 1: obtaining a matrix of Ag powder having a particle size of 200 meshes, wherein the silver is third-level atomized and then sieved through a sieve of 200 meshes;

Step 2: 600 g of reinforcing $SnO_2$ powder having a particle size of 80 nm on average and 400 g of the Ag powder obtained from step 1 are uniformly mixed and then placed into a high energy ball mill for milling, wherein the ball mill rotates at 280 rpm and the ball milling lasts for 10 hours; a scanning electron photomicrograph of the generated composite powder is showed in FIG. 1;

Step 3: 1 Kg composite powder obtained from Step 2 and 4 Kg silver powder obtained from Step 1 are poured into a V-shaped powder mixing machine to be uniformly mixed, wherein the powder mixing machine rotates at 30 rpm for 4 hours;

Step 4: the powder obtained from Step 3 is placed into a plastic tube having a diameter of 90 cm and a length of 150 cm to be processed with cold isostatic pressing, wherein the cold isostatic pressure is 100 MPa;

Step 5: the green body obtained through the cold isostatic pressing in Step 4 is sintered at 865° C. for 5 hours;

Step 6: the sintered green body obtained from Step 5 is processed with hot pressing at 800° C. under 500 MPa for 10 min; and Step 7: the green body obtained through the hot pressing is processed with hot extrusion at 800° C., wherein an extrusion ratio is 225; an extrusion speed is 5 cm/min; and a pre-heating temperature of extruding moulds is 500° C.

According to the preferred embodiment one, the $AgSnO_2$ (12) contact material with obviously neat fibrous reinforcing $SnO_2$ is finally obtained, wherein the fiber-like arrangement of $SnO_2$ is formed through directional arrangement and connection of the nanoparticles of $SnO_2$. A metallograph thereof is showed in FIG. 2. The obtained material has a tensile strength of 285 MPa, an electrical resistivity along the extrusion direction of 2.1 μΩ·cm and a hardness of 85 HV.

Embodiment Two

A preparation of AgCdO12 contact material is taken as an example.

Step 1: 600 g of reinforcement powder of CdO having particles of 1 μm on average and 200 g of Ag powder having a particle size of 400 meshes are uniformly mixed and then placed into a high energy ball mill for mixing, wherein the ball mill rotates at a speed of 240 rpm for 10 hours;

Step 2: 800 g of the composite powder obtained from the step 1 and 4200 g of silver powder having a particle size of 400 meshes are poured into a V-shaped powder mixing machine to be uniformly mixed, wherein the powder mixing machine rotates at a speed of 25 rpm for 4 hours;

Step 3: the powder obtained from Step 2 is placed into a plastic tube having a diameter of 90 cm and a length of 150 cm to be processed with cold isostatic pressing under a cold isostatic pressure of 300 MPa;

Step 4: the green body obtained from cold isostatic pressing in Step 3 is sintered at 750° C. for 9 hours;

Step 5: the sintered green body obtained from Step 4 is processed with hot pressing at 800° C. under a hot pressing pressure of 300 MPa for 20 min; and Step 6: the green body obtained from hot pressing is hot extruded into sheets at a hot extrusion temperature of 900° C., wherein an extrusion ratio is 100; an extrusion speed is 10 cm/min; and a pre-heating temperature of extruding moulds is 300° C.

According to the preferred embodiment two, AgCdO12 contact materials with a neat fiber-like arrangement of reinforcing CdO are finally obtained, wherein the fiber-like arrangement of CdO is formed through directional arrangement and connection of a number of CdO particles. The generated material has a tensile strength of 290 MPa, an electrical resistivity of 2.0 μΩ·cm and a hardness of 88 HV.

Embodiment Three

A preparation of AgZnO(8) contact material is taken as an example.

Step 1: 400 g of reinforcement powder of ZnO having particles of 100 nm on average and 800 g of Ag powder having a particle size of 400 meshes are uniformly mixed and placed in a high energy ball mill for mixing, wherein the ball mill rotates at a speed of 240 rpm for 5 hours;

Step 2: 1200 g of the composite powder obtained from Step 1 and 3800 g of silver powder having a particle size of 600 meshes are poured into a V-shaped powder mixing machine to be uniformly mixed, wherein the powder mixing machine rotates at a speed of 30 rpm for 4 hours;

Step 3: the powder obtained from Step 2 is placed into a plastic tube having a diameter of 90 cm and a length of 150 cm to be processed with cold isostatic pressing at a cold isostatic pressure of 100 MPa;

Step 4: the green body obtained from the cold isostatic pressing in Step 3 is sintered at 830° C. for 5 hours;

Step 5: the sintered green body obtained from Step 4 is processed with hot pressing at 830° C. under a hot pressing pressure of 700 MPa for 1 min; and Step 6: the green body after the hot pressing is processed with hot extruding into sheets at a hot extrusion temperature of 800° C., wherein an extrusion ratio is 324; an extrusion speed is 20 cm/min; and a pre-heating temperature of extruding moulds is 300° C.

According to the preferred embodiment three, AgZnO(8) contact materials having a neat fiber-like arrangement of reinforcing ZnO are finally obtained, wherein the fiber-like arrangement of ZnO is formed through directional arrangement and connection of ZnO particles. The generated material has a tensile strength of 280 MPa, a resistivity of 1.9 μΩ·cm and a hardness of 85 HV.

Embodiment Four

A preparation of Ag-4ZnO-8$SnO_2$ contact materials is taken as an example.

Step 1: a matrix of Ag powder having a particle size of 100 meshes is obtained, wherein the silver is third-level atomized and then sieved through a sieve of 100 meshes;

Step 2: 200 g reinforcing powder of ZnO particles of an average size of 100 nm and 400 g reinforcing powder of $SnO_2$ particles of 80 nm on average and 400 g Ag powder obtained from step 1 are uniformly mixed together and then placed into a high energy ball mill for milling, wherein the ball mill rotates at a speed of 280 rpm for 10 hours;

Step 3: 1000 g composite powder obtained from step 2 and 4000 g silver powder obtained from step 1 are poured into a V-shaped powder mixing machine to be uniformly mixed, wherein the powder mixing machine rotates at a speed of 30 rpm for 4 hours;

Step 4: the powder obtained from Step 3 is placed into a plastic tube having a diameter of 90 cm and a length of 150 cm to be processed with cold isostatic pressing, wherein the cold isostatic pressure is 200 MPa;

Step 5: the green body after the cold isostatic pressing obtained from the step 4 is sintered at 865° C. for 5 hours;

Step 6: the sintered green body obtained from Step 5 is processed with hot pressing at 800° C. under 700 MPa for 10 min; and Step 7: the green body obtained through hot pressing is processed with hot extrusion at 800° C., wherein an extrusion ratio is 400; an extrusion speed is 5 cm/min; and a pre-heating temperature of extruding moulds is 500° C.

According to the preferred embodiment four, the Ag-4ZnO-8$SnO_2$ contact material with a neat fibre-like arrangement of reinforcing ZnO and $SnO_2$ particles is finally obtained, wherein the fiber-like arrangement of ZnO and $SnO_2$ is formed through directional arrangement and connection of nanoparticles of ZnO and $SnO_2$. The generated material has a tensile strength of 255 MPa, an electrical resistivity along the extrusion direction of 2.0 μΩ·cm and a hardness of 85 HV.

Embodiment Five

A preparation of AgNi(25) contact materials is taken as an example.

Step 1: 500 g reinforcing powder of Ni having particles of 10 μm on average and 500 g Ag powder having a particle size of 300 meshes are uniformly mixed and then placed in a high energy ball mill for mixing, wherein the ball mill rotates at a speed of 280 rpm for 8 hours;

Step 2: 1000 g of the composite powder obtained from step 1 and 1000 g of silver powder having a particle size of 400 meshes are poured into a V-shaped powder mixing machine to be uniformly mixed, wherein the powder mixing machine rotates at a speed of 30 rpm for 2 hours;

Step 3: the powder obtained from step 2 is placed into a plastic tube having a diameter of 90 cm and a length of 150 cm to be processed with cold isostatic pressing at a cold isostatic pressure of 200 MPa;

Step 4: the green body obtained through cold isostatic pressing in Step 3 is sintered at 860° C. for 7 hours;

Step 5: the sintered green body obtained from step 4 is processed with hot pressing at 800° C. under a hot pressing pressure of 400 MPa for 20 min; and Step 6: the green body is hot-extruded into sheets at a hot extrusion temperature of 860° C., wherein an extrusion ratio is 225; an extrusion speed is 10 cm/min; and a pre-heating temperature of extruding moulds is 500° C.

According to the preferred embodiment five, the material of AgNi(25) with neat fiber-like arrangement of reinforcing Ni is finally obtained, wherein the fiber-like arrangement of Ni is formed through directional arrangement and connection of nanoparticles of Ni. The generated material has a tensile strength of 300 MPa, a electrical resistivity along an extrusion direction of 2.0 μΩ·cm and a hardness of 80 HV.

Embodiment Six

A preparation of $AgFe_7$ contact materials is taken as an example.

Step 1: a matrix of Ag powder having a particle size of 100 meshes is obtained, wherein the silver is third-level atomized and then sieved through a sieve of 100 meshes;

Step 2: 350 g of reinforcement powder of Fe having particles of 30 μm on average and 400 g of the Ag powder obtained from step 1 are uniformly mixed and then placed into a high energy ball mill for milling wherein the ball mill rotates at a speed of 180 rpm for 12 hours;

Step 3; 750 g of the composite powder obtained from Step 2 and 4250 g of the silver powder obtained from Step 1 are poured into a V-shaped powder mixing machine to be uniformly mixed, wherein the powder mixing machine rotates at a speed of 20 rpm for 4 hours;

Step 4: the powder obtained from Step 3 is placed into a plastic tube having a diameter of 90 cm and a length of 150 cm to be processed with cold isostatic pressing, wherein the cold isostatic pressure is 500 MPa;

Step 5: the green body obtained from cold isostatic pressing in Step 4 is sintered at 900° C. for 5 hours under protection of hydrogen atmosphere;

Step 6: the sintered green body obtained from Step 5 is processed with hot pressing at 900° C. under 700 MPa for 30 min; and Step 7: the green body after the hot pressing is processed with hot extruding at 700° C., wherein an extrusion ratio is 20; an extrusion speed is 10 cm/min; and a pre-heating temperature of extruding moulds is 400° C.

According to the sixth preferred embodiment, the material of $AgFe_7$ with a neat fiber-like arrangement of reinforcing Fe is finally obtained, wherein the fiber-like arrangement of Fe is formed through directional arrangement and connection of nanoparticles of Fe. The generated material has a tensile strength of 310 MPa, an electrical resistivity along an extrusion direction of 1.9 μΩ·cm and a hardness of 75 HV.

Embodiment Seven

A preparation of AgZnO(6) contact material is taken as an example.

Step 1: 300 g of reinforcing powder of ZnO having particles of 5 nm on average and 300 g of Ag powder having a particle size of 400 meshes are uniformly mixed and then placed in a high energy ball mill for milling, wherein the ball mill rotates at a speed of 180 rpm for 8 hours;

Step 2: 600 g of the composite powder obtained from Step 1 and 4400 g of silver powder having a particle size of 200 meshes are poured into a V-shaped powder mixing machine to be uniformly mixed, wherein the powder mixing machine rotates at a speed of 30 rpm for 4 hours;

Step 3: the powder obtained from Step 2 is placed into a plastic tube having a diameter of 90 cm and a length of 150 cm to be processed with cold isostatic pressing at a cold isostatic pressure of 300 MPa;

Step 4: the green body obtained from cold isostatic pressing in Step 3 is sintered at 600° C. for 7 hours;

Step 5: the sintered green body obtained from Step 4 is processed with hot pressing at 500° C. under a hot pressing pressure of 500 MPa for 10 min; and Step 6: the green body obtained from hot pressing is hot-extruded into sheets at a hot extrusion temperature of 600° C., wherein an extrusion ratio is 225; an extrusion speed is 5 cm/min; and a pre-heating temperature of extruding moulds is 500° C.

According to the preferred embodiment seven, the AgZnO (6) contact material with a neat fiber-like arrangement of reinforcing ZnO is finally obtained, wherein the fiber-like arrangement of ZnO is formed through directional arrangement and connection of nanoparticles of ZnO. The generated material has a tensile strength of 270 MPa, a electrical resistivity along the extrusion direction of 1.85 μΩ·cm and a hardness of 80 HV.

It should be understood that although exemplary embodiments of the contact materials and methods of the invention are described by way of illustrating the invention, the invention includes all modification and equivalents of the disclosed embodiments of the preparation of silver-based contact materials with fiber-like arrangement of reinforcing nanoparticles falling within the scope of the appended claims.

What is claimed is:

1. A method for preparing a fibrous silver-based electrical contact material, comprising following steps of:

(1) uniformly mixing reinforcement powder and matrix silver powder to obtain a mixture, and loading the mixture into a high power ball mill for ball grinding, wherein the reinforcement powder and the matrix silver powder are mixed according to a predetermined weight ratio by which silver coats on the reinforcement powder to form coated bodies and aggregates of the coated bodies are obtained after the high power ball grinding;

(2) pouring a composite powder body, namely the aggregates of the coated bodies obtained from the step (1), and the matrix silver powder into a powder mixing machine to mix, wherein a weight ratio of the composite powder body to the matrix silver powder is counted according to constituents of desired preparation materials and a predetermined fiber size, and then obtaining a powder body;

(3) processing the powder body obtained from the step (2) with cold isostatic pressing to obtain a green body;

(4) sintering the green body obtained by the cold isostatic pressing;

(5) processing the green body obtained by the sintering, with hot pressing;

(6) processing the green body obtained by the hot pressing, with hot extruding, and generating a fibrous silver-based electrical contact material.

2. The method, as recited in claim 1, wherein the step (1) adopts the silver powder having a particle size between 100 meshes and 400 meshes.

3. The method, as recited in claim 2, wherein the step (1) adopts the reinforcement powder of any material as along as the reinforcement powder are coated with silver after the reinforcement powder and the silver powder are processed with high power ball grinding; the reinforcement material is made of one material or a mixture of more than one material.

4. The method, as recited in claimer 1, wherein, in the step (1), a weight ratio of the reinforcement powder to the silver powder is between 0.5and 3; the ball mill rotates at a speed between 180 rpm and 280 rpm; the ball grinding last for 5 hours to 12 hours.

5. The method, as recited in claim 3, wherein, in the step (1), a weight ratio of the reinforcement powder to the silver powder is between 0.5 and 3; the ball mill rotates at a speed between 180 rpm and 280 rpm; the ball grinding last for 5 hours to 12 hours.

6. The method, as recited in claim 1, wherein, in the step (2), the weight ratio of the composite powder body and the matrix silver powder is between 1 and 0.136; the powder mixing machine rotates at a speed between 20 rpm and 30 rpm; the powder mixing lasts for 2 hours to 4 hours.

7. The method, as recited in claim 5, wherein, in the step (2), the weight ratio of the composite powder body and the matrix silver powder is between 1 and 0.136; the powder mixing machine rotates at a speed between 20 rpm and 30 rpm; the powder mixing lasts for 2 hours to 4 hours.

8. The method, as recited in claim 1, wherein the step (3) comprises the cold isostatic pressing under a cold isostatic pressure between 100 MPa and 500 MPa.

9. The method, as recited in claim 7, wherein the step (3) comprises the cold isostatic pressing under a cold isostatic pressure between 100 MPa and 500 MPa.

10. The method, as recited in claim 1, wherein the step (4) comprises the sintering; a sintering temperature is between 600° C. and 900° C. and the sintering lasts for 5 hours to 9 hours.

11. The method, as recited in claim 9, wherein the step (4) comprises the sintering; a sintering temperature is between 600° C. and 900° C. and the sintering lasts for 5 hours to 9 hours.

12. The method, as recited in claim 1, wherein the step (5) comprises the hot pressing; a hot pressing temperature is between 500° C. and 900° C.; a hot pressing pressure is between 300 MPa and 700 MPa; the hot pressing lasts for 1 min to 30 min.

13. The method, as recited in claim 11, wherein the step (5) comprises the hot pressing; a hot pressing temperature is between 500° C. and 900° C.; a hot pressing pressure is between 300 MPa and 700 MPa; the hot pressing lasts for 1 min to 30 min.

14. The method, as recited in claim 1, wherein the step (6) comprises the hot extruding; the green body is heated under a temperature between 600° C. and 900° C.; an extrusion ratio is between 20 and 400; an extrusion speed is between 5 cm/min and 20 cm/min; a pre-heating temperature of extruding moulds is between 300° C. and 500° C.

15. The method, as recited in claim 13, wherein the step (6) comprises the hot extruding; the green body is heated under a temperature between 600° C. and 900° C.; an extrusion ratio is between 20 and 400; an extrusion speed is between 5 cm/min and 20 cm/min; a pre-heating temperature of extruding moulds is between 300° C. and 500° C.

16. A fibrous silver-based electrical contact material produced by the method as recited in claim 1, wherein said fibrous silver-based electrical contact material has an obvious fibrous reinforcement material, wherein a fibrous structure of said reinforcement material is formed by particles thereof arranged along a predetermined direction; powder particles of said fibrous reinforcement material have an average size of 5 nm to 30 μm; said powder particles can be of any material as along as said powder particles are coated with silver after said powder particles and silver powder are processed with high power ball grinding; and said reinforcement material can be made of one material or a mixture of more than one material.

17. A fibrous silver-based electrical contact material produced by the method as recited in claim 15, wherein said fibrous silver-based electrical contact material has an obvious fibrous reinforcement material, wherein a fibrous structure of said reinforcement material is formed by particles thereof arranged along a predetermined direction; powder particles of said fibrous reinforcement material have an average size of 5 nm to 30 μm; said powder particles can be of any material as along as said powder particles are coated with silver after said powder particles and silver powder are processed with high power ball grinding; and said reinforcement material can be made of one material or a mixture of more than one material.

* * * * *